US008438674B1

(12) United States Patent
Balkum

(10) Patent No.: US 8,438,674 B1
(45) Date of Patent: May 14, 2013

(54) DISHWASHING PAN

(76) Inventor: Frank R. Balkum, Pawtucket, RI (US)

( * ) Notice: Subject to any disclaimer, the term of this patent is extended or adjusted under 35 U.S.C. 154(b) by 41 days.

(21) Appl. No.: 13/192,754

(22) Filed: Jul. 28, 2011

(51) Int. Cl.
*E03C 1/32* (2006.01)

(52) U.S. Cl.
USPC ..... 4/643

(58) Field of Classification Search ..... 4/619–660
See application file for complete search history.

(56) References Cited

U.S. PATENT DOCUMENTS

| | | | | |
|---|---|---|---|---|
| 1,252,220 | A * | 1/1918 | Benson | 220/4.03 |
| 3,027,041 | A * | 3/1962 | Stansbury, Jr. et al. | 220/572 |
| D261,602 | S * | 11/1981 | Anderson | D32/55 |
| 5,385,261 | A | 1/1995 | Lippisch et al. | |
| D364,018 | S | 11/1995 | Brightbill et al. | |
| D373,866 | S | 9/1996 | Belden, Jr. et al. | |
| 5,588,539 | A | 12/1996 | Belden, Jr. et al. | |
| 6,405,388 | B1 | 6/2002 | Brown | |
| D485,283 | S | 1/2004 | Shuck | |
| D599,067 | S | 8/2009 | Yang et al. | |
| D624,721 | S * | 9/2010 | Curtin | D32/55 |
| 7,861,883 | B2 * | 1/2011 | Purushothaman | 220/488 |
| 7,954,183 | B2 * | 6/2011 | Cawthon | 4/650 |

* cited by examiner

*Primary Examiner* — Lori Baker
(74) *Attorney, Agent, or Firm* — Salter & Michaelson

(57) ABSTRACT

A dish washing pan constructed of a housing having a bottom and multiple sidewalls integrally formed with the bottom to provide a washing chamber, a plurality of legs attached at the underside of the housing bottom to support the bottom over a sink surface and a plurality of holes provided in each of the sidewalls at a location spaced downwardly from a top rim of the sidewall. The plurality of holes is disposed closer to the top rim than the bottom of the housing. An outlet is provided in one of the sidewalls that can be closed to retain water in the washing chamber or opened to enable the water to be discharged from the washing chamber. The outlet is disposed closer to the bottom of the housing than the top rim.

2 Claims, 5 Drawing Sheets

DISHWASHING PAN

FIELD OF THE INVENTION

The present invention relates in general to a dishwashing pan and pertains, more particularly, to an improvement in a dishwashing pan that enables the water to be retained in the pan and yet easily discharged from the pan.

BACKGROUND OF THE INVENTION

A dishwashing pan is commonly used in a sink for holding dishes or other kitchen utensils. These dishes or utensils are typically stored in the pan and the pan is filled with water and usually a detergent of some type. The problem with existing dishwashing pans is that the bottom of the pan usually sits directly on the sink surface and thus the drain to the sink is blocked. This can cause excess water to fill in the sink which is undesirable. Also, with existing dishwashing pans, there is no effective way of discharging the water from the pan other than to tip the pan over which can cause excess water to spill, not only into the sink but into the area around the sink.

Accordingly, it is an object of the present invention to provide a dishwashing pan of improved construction.

SUMMARY OF THE INVENTION

To accomplish the foregoing and other objects, features and advantages of the present invention there is provided a dish washing pan comprising: a housing having a bottom and multiple sidewalls integrally formed with the bottom to provide a washing chamber; a plurality of legs attached at the underside of the housing bottom to support the bottom over a sink surface; and a plurality of holes provided in each of the sidewalls at a location spaced downwardly from a top rim of the sidewall. The plurality of holes is disposed closer to the top rim than the bottom of the housing. An outlet is provided in one of the sidewalls that can be closed to retain water in the washing chamber or opened to enable the water to be discharged from the washing chamber. The outlet is disposed closer to the bottom of the housing than the top rim.

In accordance with other aspects of the present invention the housing is constructed of a plastic material; the housing has four sides and each side has a plurality of holes therein; each hole of the plurality is of the same diameter on a particular sidewall; the holes on a sidewall are disposed along a linear path and are each spaced an equal distance apart from each other; the plurality of holes in each of the sidewalls is disposed the same distance from the top rim; each hole has a diameter on the order of one quarter inch; the set of holes in each sidewall are disposed on the order of one inch down from the top rim; the set of holes are arranged symmetrically with respect to sides of the sidewalls; the outlet is formed by an opening and further including a cap for engaging the opening; the cap is threaded to an annular flange that is disposed about the outlet, the cap being threaded on for retaining the water and unthreaded for discharging the water; the cap is internally threaded and the flange is externally threaded; alternatively including a valve at the outlet that has respective open and closed positions; the outlet has a diameter on the order of three fourths of an inch; each of the holes in the sidewalls has a diameter on the order of one quarter inch; all of the holes are arranged along a linear path and are centered at a distance of about one inch from the top rim of the housing; and the outlet is disposed at a distance of about one inch from the bottom of the housing.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
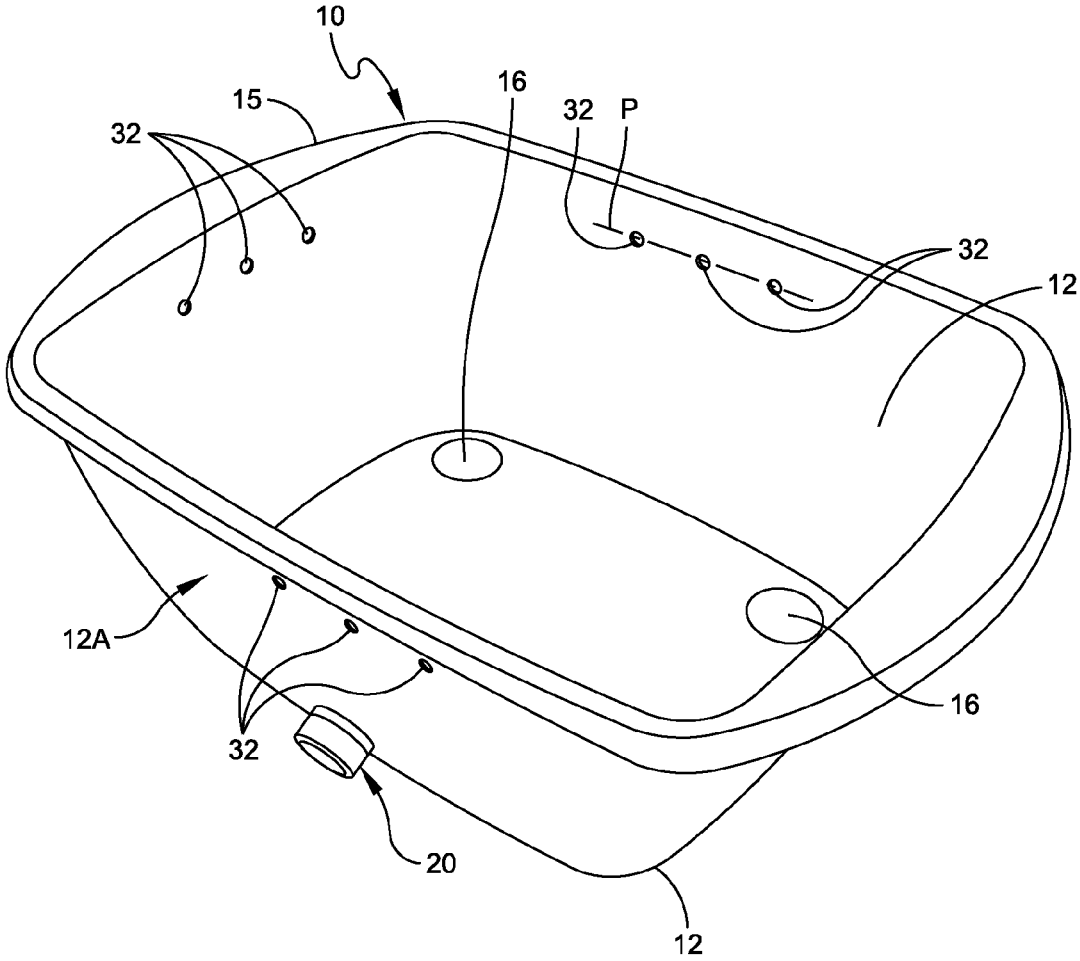
FIG. 1 is a perspective view of the dishwashing pan of the present invention.
Figure 2:
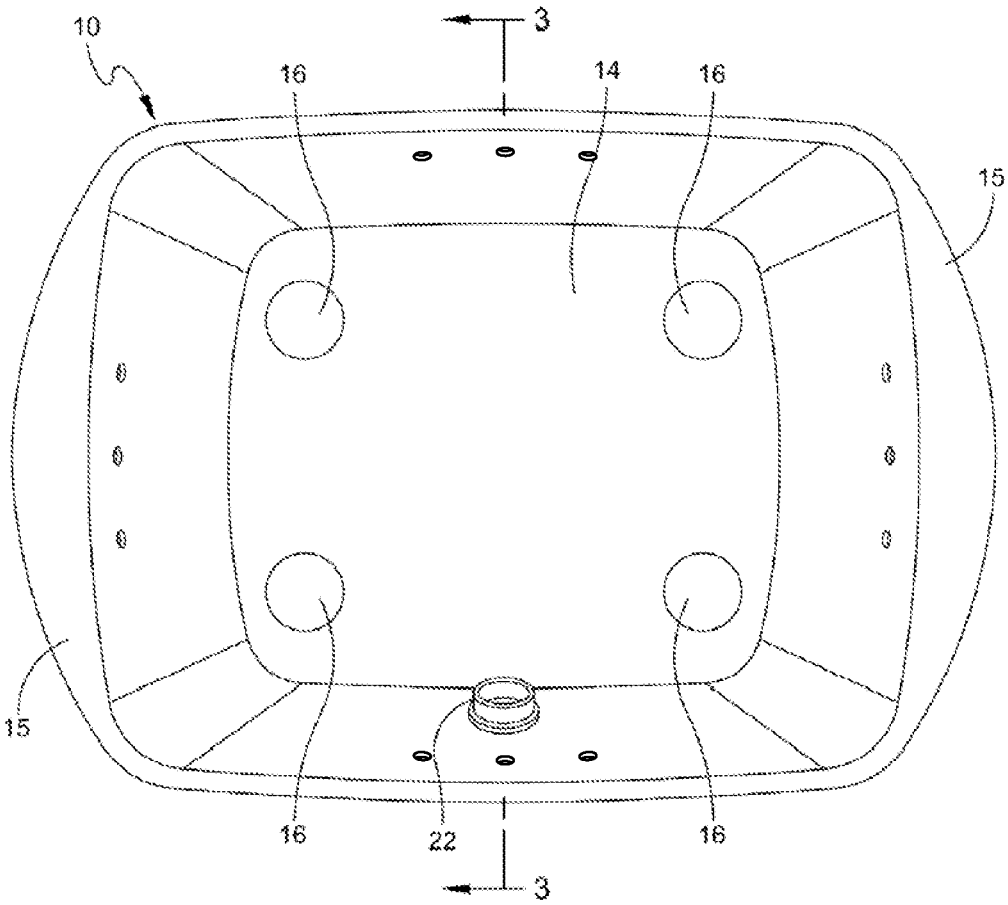
FIG. 2 is a top plan view of the dishwashing pan.

Reference is now made to the drawings for one embodiment of the dishwashing pan constructed in accordance with the principles of the present invention. This pan is in the form of a housing 10 that has multiple sidewalls 12 integrally formed with a bottom 14. The dishwashing pan is preferably constructed as a single molded piece. In the disclosed embodiment there are four sidewalls that are all integrally formed with each other, as well as integrally formed with the bottom 14. The housing 10 is preferably constructed of a semi-transparent plastic material and at the top of each of the sidewalls there is a top rim 15. The housing 10 may also be constructed in other shapes or forms including square and round constructions. Also, the housing may be constructed as translucent or of different colors such as white, gray and brown. At the sides, the rim 15 may extend sufficiently so as to form a partial handle in moving the dishwashing pan. The bottom 14 has integrally formed therewith a plurality of legs 16. In the illustrated embodiment there are four legs 16 disposed in the pattern illustrated in the plan view of FIG. 2. Each of these legs 16 may be in the form of an integrally formed dimple or bump. This enables the bottom 14 to be sufficiently elevated about the sink surface 17 where the drain 18 is provided. By employing the plurality of legs 16, this elevates the dishwashing pan a sufficient distance above the sink surface 17 so that if any water gets into the sink, it is allowed to pass through the drain 18.

Figure 3:
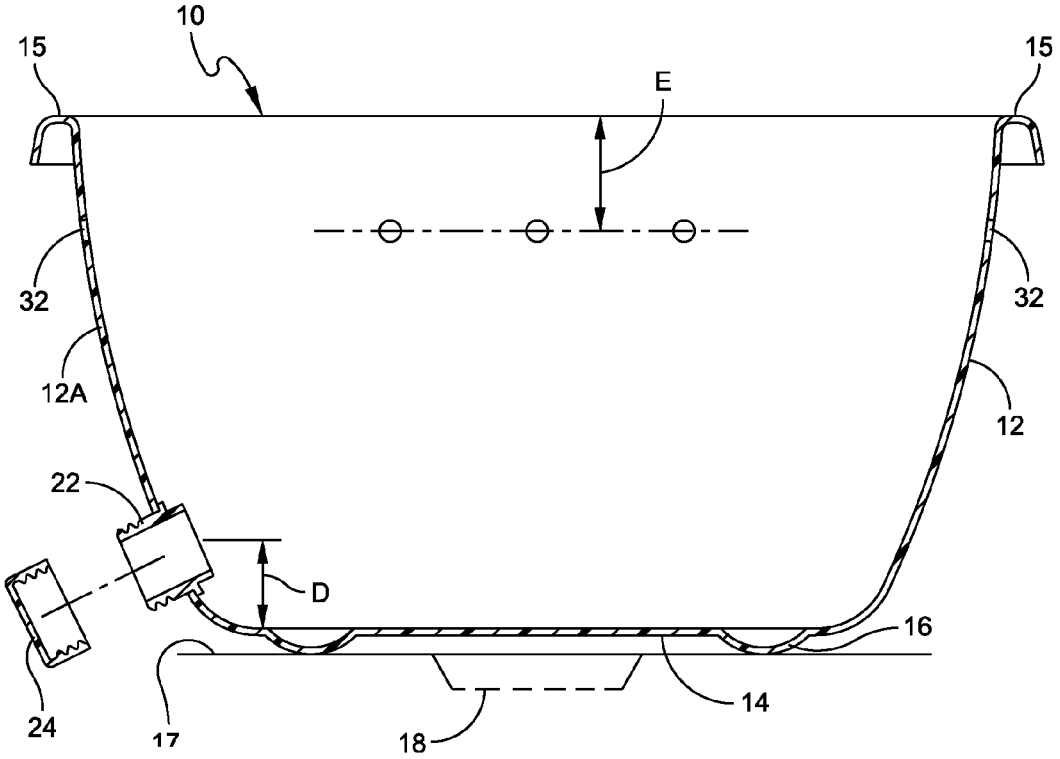
FIG. 3 is a cross-sectional view taken along line 3-3 of FIG. 2.
Figure 4:
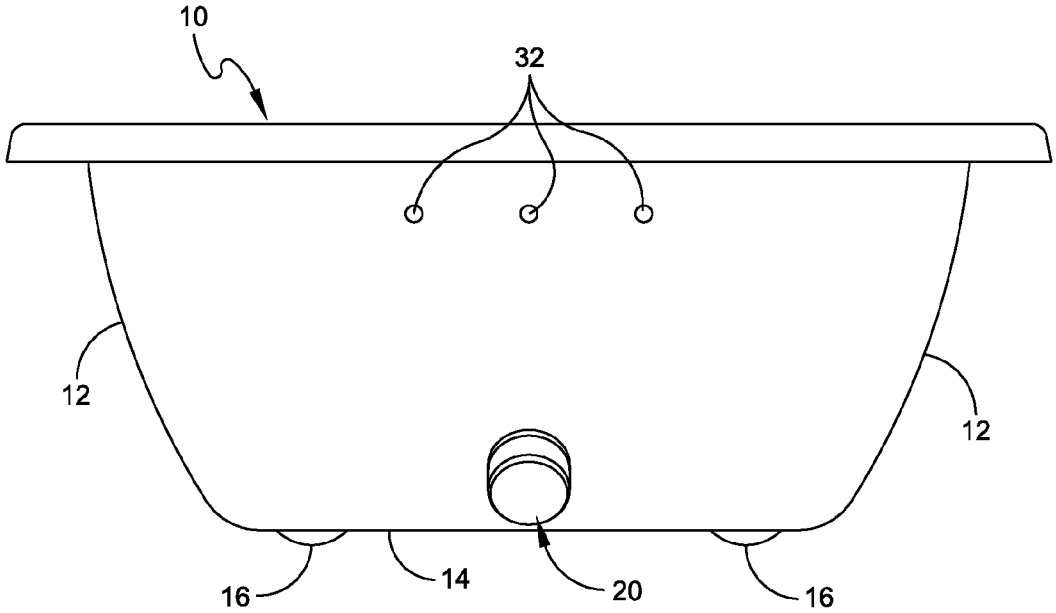
FIG. 4 is a front view of the dishwashing pan.

Now, in order to assist in discharging the water from the dishwashing pan, there is provided an outlet at 20. Refer to the cross-sectional view of FIG. 3 that shows the construction at the outlet 20. This includes an externally threaded annular flange 22 and an internally threaded cap 24 that is adapted to threadedly mate with the externally threaded flange 22. When the cap 24 is threaded onto the flange 22, then the water is retained within the dishwashing basin. The cap 24 may be easily unthreaded to enable the water to be discharged from the dishwashing pan. The flange 22 is arranged so that there is an open passage therethrough. This passage is illustrated in the cross-sectional view of FIG. 3 as through the wall 12A. In accordance with the present invention, the center of the outlet 20; dimension D in FIG. 3 is on the order of one inch from the bottom of the bottom wall 14. Preferably, a single outlet is employed and this is preferably provided on the front sidewall as depicted in FIG. 4.

Reference is also now made to an alternate embodiment to the combination of flange and cap illustrated in FIGS. 1-5.

Figure 6:
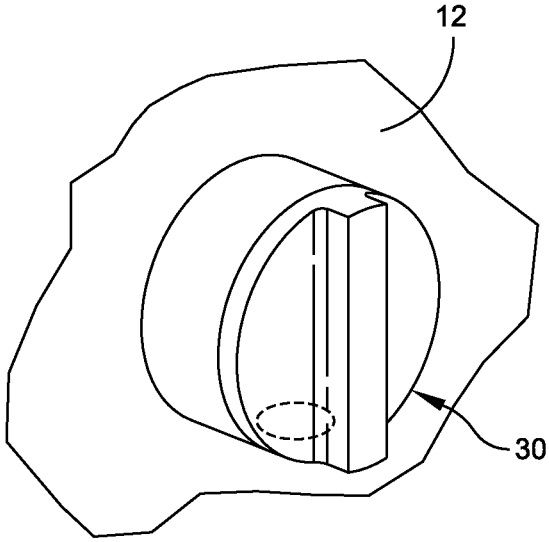
FIG. 6 is an enlarged fragmentary perspective view illustrating an alternate valve construction for the dishwashing pan outlet.

This is illustrated in FIG. 6 by the valve member 30. This is essentially in place of the cap 24 and has alternate open and closed positions. When the valve 30 is moved to the open position, then there is a free passage through the wall 12A. When the valve 30 is moved or rotated to the closed position, then the passage in the wall 12A is blocked.

Figure 5:
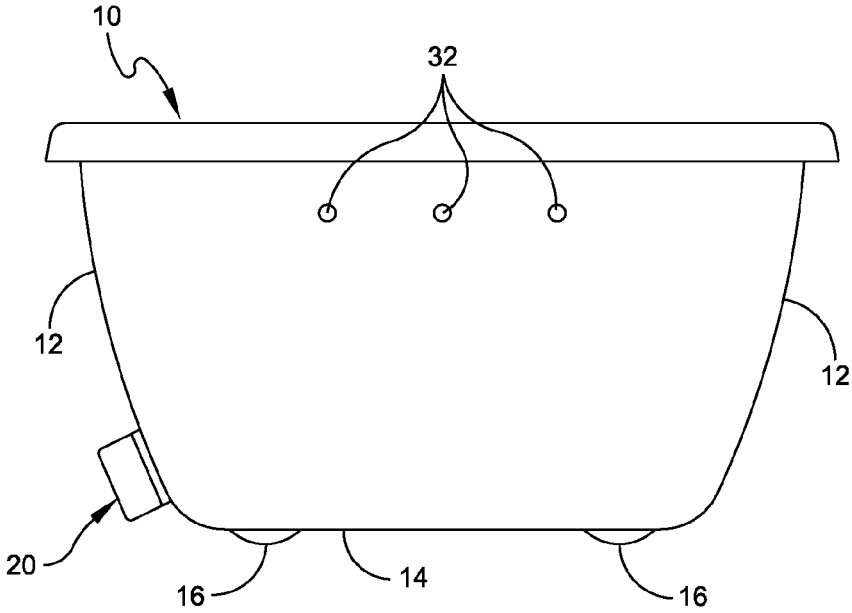
FIG. 5 is a side view of the dishwashing pan.

The housing 10 is also provided with a plurality of holes 32 provided in each of the sidewalls and disposed at a location spaced downwardly from the top rim 15. In the illustrated embodiment, the housing is constructed with four sides and each side has a plurality of holes 32 therein. Preferably, each of the holes of the plurality of the holes is of the same diameter. Also, the holes in any one particular sidewall are disposed along a linear path P and each are preferably spaced an equal distance apart from each other. Also, preferably the plurality of holes in each of the sidewalls is disposed about the same distance from the top rim with respect to each of the separate sidewalls. The diameter of each of the holes 32 is preferably on the order of ¼ inch and may be in a range of ⅛ to ⅜ inch in diameter. The array of holes also preferably is disposed on the order of about one inch down from the top rim 15. Also, the set of holes are preferably arranged symmetrically with respect to the sides of the sidewalls. In other words, the holes 32, such as depicted in either FIG. 4 or FIG. 5 is symmetric with respect to the opposed sidewalls.

An advantage of the present invention is the ability to provide a plurality of discharge holes 32. These allow for an overflow before the full pan is filled with water. This thus reduces the maximum weight of water that can be accumulated in the dishwashing pan. It is also important that these holes 32 be provided on all sidewall surfaces and on each of the sidewall surfaces there are a plurality of such holes disposed in a linear array and equally spaced from the top edge rim of each sidewall. In this way, should the dishwashing pan be overfilled, the water will be discharged evenly from all sides of the pan thus averting any substantial spillage. Because the diameter of the holes 32 is relatively small, only a small amount of water is discharged through each of the holes but the cumulative effect is that the water discharge will maintain the water level at the level of the holes 32 thus preventing any overfilling of the dishwashing pan.

Another important aspect of the present invention is the use of an outlet that preferably is of a diameter substantially larger than any of the holes 32. This outlet is preferably provided at a lower position on a sidewall and enables a ready discharge of a substantial amount of water when one desires to empty the dishwashing pan. This avoids having to tip the pan which can cause unnecessary spillage.

Another important aspect of the present invention relates to the use of legs on the bottom wall 14. This elevates the bottom of the pan over a sink drain and thus in this way the dishwashing pan will not block the passage of water into the sink drain.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A dish washing pan comprising:

a housing having a bottom and multiple sidewalls integrally formed with the bottom to provide a washing chamber, and a top rim that extends continuously about all sidewalls;

wherein the housing is constructed of a plastic material;

said housing further including four rounded corners that interconnect respective sidewalls with first opposed sidewalls being wider than second opposed sidewalls;

wherein the rim at the wider first opposed sidewalls is wider than the rim at the second opposed sidewalls;

a plurality of legs attached at the underside of the housing bottom to support the bottom over a sink surface;

each leg formed by a concave dimple in the bottom of the housing with each dimple disposed adjacent to a respective rounded corner;

a plurality of holes provided in each of the sidewalls at a location spaced downwardly from the top rim of the sidewalls;

said plurality of holes disposed closer to the top rim than the bottom of the housing;

an outlet in one of the wider sidewalls that can be closed to retain water in the washing chamber or opened to enable the water to be discharged from the washing chamber;

said outlet disposed closer to the bottom of the housing than the top rim;

wherein the housing has four sides and each side has a set of a plurality of holes therein;

wherein the holes on a sidewall are disposed along a linear path and are each spaced a distance apart from each other;

wherein each hole of the plurality is of the same diameter on each sidewall;

wherein the set of plurality of holes in each of the sidewalls is disposed the same distance from the top rim;

wherein the set of holes in each sidewall is disposed on the order of one inch down from the top rim;

wherein the set of holes are arranged symmetrically with respect to ends of the sidewalls;

wherein the outlet is formed by an opening and further including an outwardly directed annular flange and a valve disposed within the flange and at the opening that has respective open and closed positions;

wherein, when the valve is moved to the open position, then there is free passage through the opening, and when the valve is moved or rotated to the closed position, the opening is blocked;

wherein each set of holes comprises at least three holes;

wherein the sets of holes in each sidewall provide for drainage from the washing chamber at each sidewall the valve;

and wherein the distance between end holes in a set is less than the spacing between respective adjacent sidewall hole sets.

2. A dish washing pan comprising:

a housing having a bottom and multiple sidewalls integrally formed with the bottom to provide a washing chamber, and a top rim that extends continuously about all sidewalls;

wherein the housing is constructed of a plastic material;

said housing further including four rounded corners that interconnect respective sidewalls with first opposed sidewalls being wider than second opposed sidewalls;

wherein the rim at the wider first opposed sidewalls is wider than the rim at the second opposed sidewalls;

a plurality of legs attached at the underside of the housing bottom to support the bottom over a sink surface;

each leg formed by a concave dimple in the bottom of the housing with each dimple disposed adjacent to a respective rounded corner;

a plurality of holes provided in each of the sidewalls at a location spaced downwardly from the top rim of the sidewalls;

said plurality of holes disposed closer to the top rim than the bottom of the housing;

an outlet in one of the wider sidewalls that can be closed to retain water in the washing chamber or opened to enable the water to be discharged from the washing chamber;

said outlet disposed closer to the bottom of the housing than the top rim;

wherein the housing has four sides and each side has a set of a plurality of holes therein;

wherein the holes on a sidewall are disposed along a linear path and are each spaced a distance apart from each other;

wherein each hole of the plurality is of the same diameter on each sidewall;

wherein the set of plurality of holes in each of the sidewalls is disposed the same distance from the top rim;

wherein the set of holes in each sidewall is disposed on the order of one inch down from the top rim;

wherein the set of holes are arranged symmetrically with respect to ends of the sidewalls;

wherein the outlet is formed by an opening and further including an outwardly directed annular flange and a cap disposed at the flange and engageable at the opening;

wherein the cap is threaded to the annular flange that is disposed about the outlet, the cap being threaded on for retaining the water and unthreaded for discharging the water;

wherein the cap is internally threaded and the flange is externally threaded;

wherein, when the cap is removed then there is free passage through the opening, and when the cap is secured to the flange the opening is blocked;

wherein each set of holes comprises at least three holes;

wherein the sets of holes in each sidewall provide for drainage from the washing chamber at each sidewall other than the passage;

and wherein the distance between end holes in a set is less than the spacing between respective adjacent sidewall hole sets.

* * * * *